US010358933B2

(12) United States Patent
Moxon

(10) Patent No.: US 10,358,933 B2
(45) Date of Patent: Jul. 23, 2019

(54) TURBINE TIP CLEARANCE CONTROL METHOD AND SYSTEM

(71) Applicant: ROLLS-ROYCE PLC, London (GB)

(72) Inventor: Matthew Moxon, Derby (GB)

(73) Assignee: ROLLS-ROYCE plc, London (GB)

( * ) Notice: Subject to any disclaimer, the term of this patent is extended or adjusted under 35 U.S.C. 154(b) by 0 days.

(21) Appl. No.: 15/692,619

(22) Filed: Aug. 31, 2017

(65) Prior Publication Data

US 2018/0073382 A1 Mar. 15, 2018

(30) Foreign Application Priority Data

Sep. 15, 2016 (GB) ..... 1615672.1

(51) Int. Cl.

| | |
|---|---|
| ***F01D 11/24*** | (2006.01) |
| ***F04D 27/02*** | (2006.01) |
| ***F04D 27/00*** | (2006.01) |
| *F01D 17/14* | (2006.01) |

(52) U.S. Cl.

CPC ..... *F01D 11/24* (2013.01); *F04D 27/001* (2013.01); *F04D 27/002* (2013.01); *F04D 27/0246* (2013.01); *F01D 17/145* (2013.01); *F05D 2220/323* (2013.01); *F05D 2240/307* (2013.01); *F05D 2260/82* (2013.01); *F05D 2270/11* (2013.01); *F05D 2270/30* (2013.01)

(58) Field of Classification Search

CPC ..... F01D 5/20; F01D 11/122; F01D 11/20; F01D 11/14; F01D 11/18; F01D 11/22

See application file for complete search history.

(56) References Cited

U.S. PATENT DOCUMENTS

| | | | | |
|---|---|---|---|---|
| 4,856,272 A * | 8/1989 | Putman | ..... | F01D 11/24 60/782 |
| 5,791,872 A * | 8/1998 | Owen | ..... | F01D 11/24 415/173.2 |
| 6,063,129 A | 5/2000 | Dadd et al. | | |
| 6,463,380 B1 | 10/2002 | Ablett et al. | | |

(Continued)

FOREIGN PATENT DOCUMENTS

| | | | |
|---|---|---|---|
| DE | 102008055593 | A1 | 7/2009 |
| EP | 1550791 | A2 | 7/2005 |

(Continued)

OTHER PUBLICATIONS

Mar. 6, 2017 Search Report issued in British Patent Application No. 1615672.1.

*Primary Examiner* — Long T Tran

(74) *Attorney, Agent, or Firm* — Oliff PLC

(57) ABSTRACT

A method of controlling a rotor tip clearance in a gas turbine engine (10). The method comprises determining an engine or component remaining useful life $T_r$, and controlling a tip clearance control arrangement (38) to maintain a rotor tip clearance (36) at a target tip clearance $D_{target}$. The target tip clearance $D_{target}$ is determined in accordance with a function of remaining engine life $T_r$.

6 Claims, 3 Drawing Sheets

(56) References Cited

U.S. PATENT DOCUMENTS

2005/0149274 A1* 7/2005 Finnigan ..... F01D 11/025 702/33
2005/0252000 A1 11/2005 Cardarella et al.
2005/0276690 A1 12/2005 Amiot et al.
2006/0013681 A1* 1/2006 Cardarella, Jr. ..... F01D 11/02 415/1
2006/0051197 A1 3/2006 Regunath
2006/0140755 A1 6/2006 Schwarz et al.
2007/0055392 A1 3/2007 D'Amato et al.
2007/0276578 A1* 11/2007 Herron ..... F01D 11/24 701/100
2008/0206039 A1 8/2008 Kane
2009/0037035 A1 2/2009 Hershey et al.
2009/0044542 A1 2/2009 Thatcher et al.
2009/0297330 A1 12/2009 Razzell et al.
2009/0317228 A1 12/2009 Werner
2009/0319150 A1 12/2009 Plunkett et al.
2010/0196137 A1 8/2010 Horn et al.
2010/0232943 A1 9/2010 Ward et al.
2012/0092179 A1 4/2012 Pg et al.
2013/0191004 A1 7/2013 Beecroft et al.
2014/0321985 A1* 10/2014 Lewis ..... F01D 11/20 415/139
2015/0159499 A1* 6/2015 Bacic ..... F01D 11/14 415/1
2015/0247417 A1* 9/2015 Bacic ..... F01D 21/14 415/1
2015/0378364 A1* 12/2015 Karpman ..... G05B 23/0254 700/282

FOREIGN PATENT DOCUMENTS

EP 2620601 A2 7/2013
JP 2009-162231 A 7/2009

* cited by examiner

TURBINE TIP CLEARANCE CONTROL METHOD AND SYSTEM

FIELD OF THE INVENTION

The present invention relates to a turbine tip clearance control method and a system for turbine tip clearance control.

BACKGROUND TO THE INVENTION

In modern gas turbine engines, the rotating components such as the compressor and turbine are designed such that rotor tip clearances are minimised such that gases flowing through the clearance (and thereby not utilised for performing work) is minimised. By minimising rotor tip clearance, engine thermodynamic efficiency is maximised.

However, a small gap must remain in order to prevent excessive tip rubs between the rotor blade and casing. Excessive tip rubs may result in the rotor blade becoming worn, which will in turn shorten the time between overhauls. There is therefore a conflict between the need to minimise the tip clearance for maximum thermodynamic efficiency, and the need to avoid tip rubs in order to extend service life.

Many gas turbine engines utilise "Active Tip Clearance Control" (TCC) arrangements in order to maintain the tip clearance at an optimum value. Tip clearance is difficult to measure directly, and so many prior arrangements use schedules based on a predicted evolution of the turbine to adjust turbine tip clearance. European patent application EP2620601 discloses a TCC arrangement in which the clearance is adjusted over the life of the engine to maintain a target tip clearance. The target tip clearance is constant, and is chosen to minimise fuel burn, while avoiding tip rubs. Similar arrangements are also known for compressor rotors.

The present invention describes a method of controlling a rotor tip clearance in a gas turbine engine and a rotor tip clearance control system which seeks to overcome some or all of the above problems.

SUMMARY OF THE INVENTION

According to a first aspect of the present invention, there is provided a method of controlling a rotor tip clearance in a gas turbine engine, the method comprising:

determining an engine or component remaining useful life $T_r$;

controlling a tip clearance control arrangement to maintain a rotor tip clearance at a target tip clearance $D_{target}$, wherein the target tip clearance $D_{target}$ is determined in accordance with a function of remaining engine life $T_r$.

It has been found that, in some instances, the negative consequences of a tip rub event diminish as the remaining engine life expires, while the benefits of a reduced tip clearance are maintained. Consequently, the target tip clearance can be reduced as remaining engine life reduces, enabling reduced specific fuel consumption while meeting the requirement for adequate engine or component life.

The step of determining the target tip clearance $D_{target}$ may comprise:

(a) determining a nominal remaining life fuel burn change $\Delta FB_{reduced}$ associated with a reduced tip clearance $D_{reduced}$ (b) determining a tip rub probability $P_{rub}$ associated with the reduced tip clearance $D_{reduced}$ (c) determining a remaining life fuel burn change $\Delta FB_{rub}$ associated with a tip rub;

(d) determining a risk adjusted remaining life fuel burn $FB_{adjusted}$ for the reduced tip clearance; and (e) where the risk adjusted remaining engine life fuel burn change $\Delta FB_{adjusted}$ is less than zero, setting the target tip clearance $D_{target}$ to the reduced tip clearance $D_{reduced}$.

The step of determining the target tip clearance $D_{target}$ may further comprise: predicting an abradable liner thickness at the expiry of the remaining useful life where the engine is operated at the reduced tip clearance $D_{reduced}$, and setting the target tip clearance $D_{target}$ at the reduced tip clearance $D_{target}$ only where the predicted abradable liner thickness at the expiry of the remaining useful life exceeds a minimum threshold.

The rotor may comprise one of a turbine rotor and a compressor rotor.

The remaining engine life may comprise one or more of a number of flight hours prior to the next engine overhaul, and a number of flight cycles prior to the next engine overhaul.

According to a second aspect of the present invention, there is provided a gas turbine engine rotor tip clearance control apparatus comprising a tip clearance controller configured to maintain a tip clearance at a target tip clearance $D_{target}$, the target tip clearance being determined in accordance with a function of remaining engine life $T_r$.

DETAILED DESCRIPTION

Figure 1:
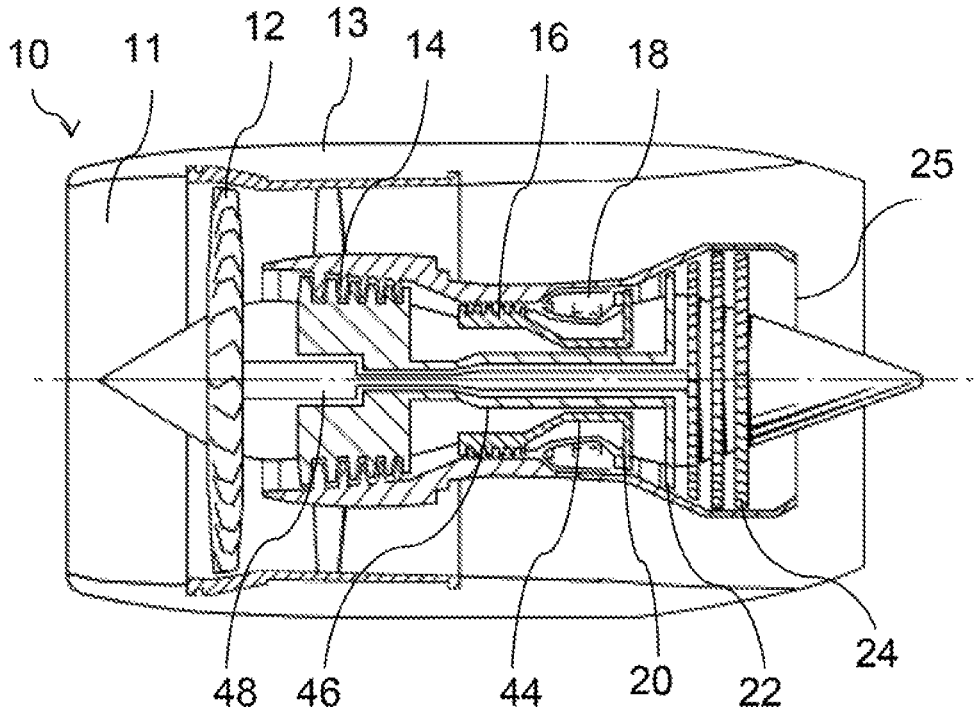
FIG. 1 shows a schematic cross sectional view of a gas turbine engine.
Figure 2:
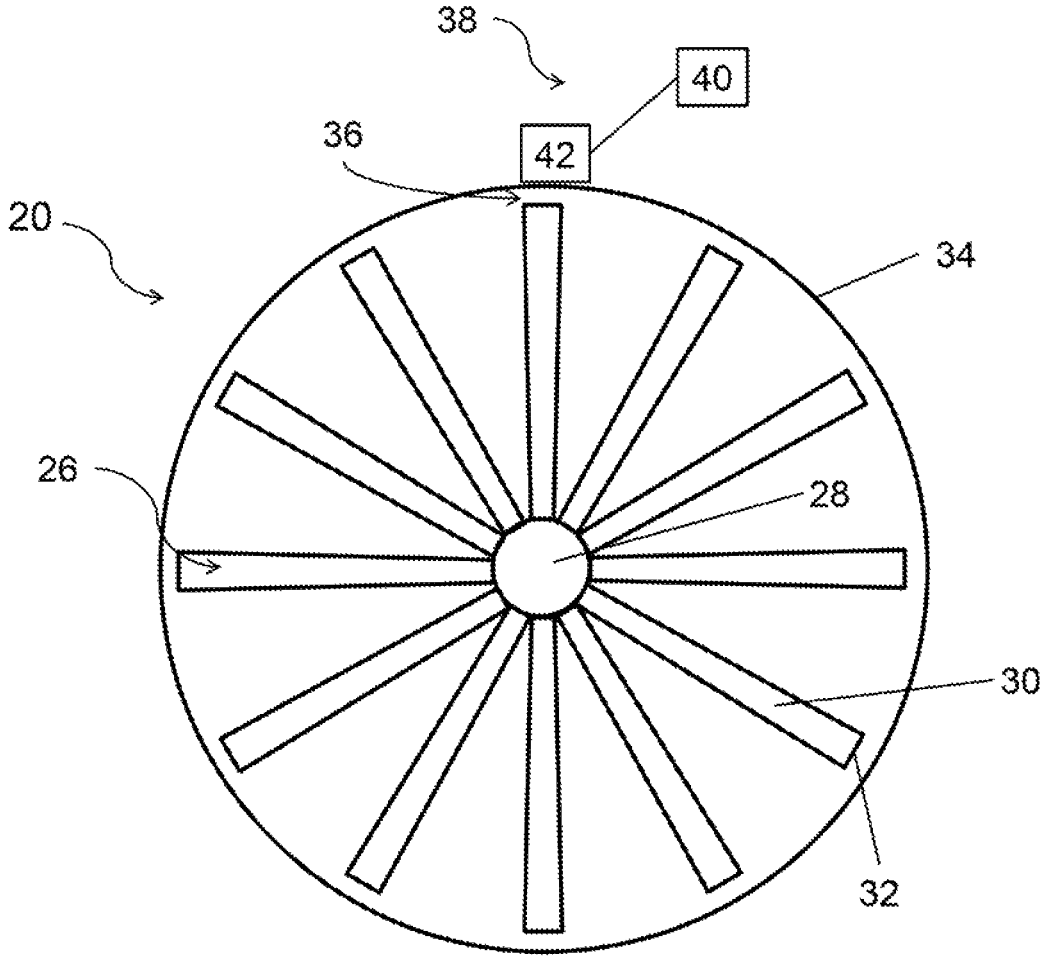
FIG. 2 shows a schematic cross sectional view of a tip clearance arrangement for the gas turbine engine of FIG. 1.

FIGS. 1 and 2 show a gas turbine engine 10. FIG. 1 shows a high-bypass gas turbine engine 10. The engine 10 comprises, in axial flow series, an air intake duct 11, an intake fan 12, a bypass duct 13, an intermediate pressure compressor 14, a high pressure compressor 16, a combustor 18, a high pressure turbine 20, an intermediate pressure turbine 22, a low pressure turbine 24 and an exhaust nozzle 25. The fan 12, compressors 14, 16 and turbines 20, 22, 24 all rotate about the major axis of the gas turbine engine 10 and so define the axial direction of gas turbine engine.

Air is drawn through the air intake duct 11 by the intake fan 12 where it is accelerated. A significant portion of the airflow is discharged through the bypass duct 13 generating a corresponding portion of the engine 10 thrust. The remainder is drawn through the intermediate pressure compressor 14 into what is termed the core of the engine 10 where the air is compressed. A further stage of compression takes place in the high pressure compressor 16 before the air is mixed with fuel and burned in the combustor 18. The resulting hot working fluid is discharged through the high pressure turbine 20, the intermediate pressure turbine 22 and the low pressure turbine 24 in series where work is extracted from the working fluid. The work extracted drives the intake fan 12, the intermediate pressure compressor 14 and the high pressure compressor 16 via shafts 44, 46, 48. The working fluid, which has reduced in pressure and temperature, is then expelled through the exhaust nozzle 25 and generates the remaining portion of the engine 10 thrust.

FIG. 2 shows the high pressure turbine 20 in more detail. The turbine 20 comprises a plurality of nozzle guide vanes (not shown), which direct air to a plurality of turbine rotor blades 26. Each rotor blade 26 is fixed to a turbine disc 28. The blades 26 and disc 28 are driven by the high pressure shaft 44. The blades 46 are surrounding within an annular turbine casing 34. A spacing 36 between a tip 32 of the blades 26 and the casing 34 is known as the turbine tip clearance.

Figure 3:
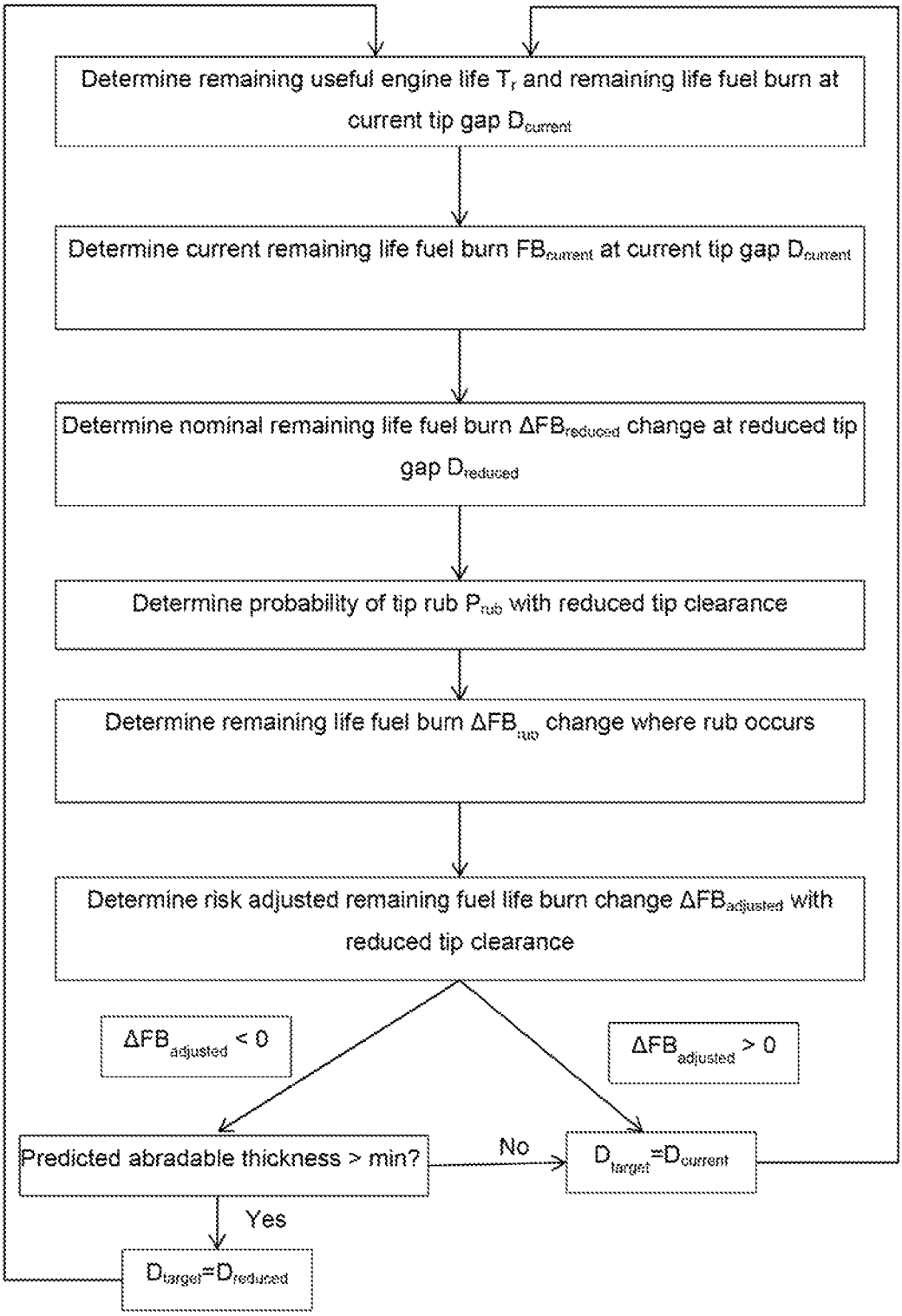
FIG. 3 shows a process flow diagram illustrating a method of controlling a tip clearance.

A tip clearance control arrangement 38 is provided, which comprises a valve 42 which is actuable to control cooling airflow to an exterior of the turbine casing 34. The cooling airflow thereby controls expansion and contraction of the case, to thereby control tip clearance. The valve 42 is controlled by a controller 40 in accordance with the method described below with reference to FIG. 3. The controller 40 may comprise an engine controller such as a FADEC, or may comprise a separate controller. The method described below could be implemented by dedicated hardware, or by software run on a general purpose computer.

In a first step, a predicted remaining useful engine life $T_r$ is determined. The remaining useful engine life may be in terms of numbers of engine cycles (where one cycle comprises starting the engine, running the engine for a period of time, and shutting down the engine), a number of engine hours, or a more complex metric, such as a weighted figure that takes into account engine cycles, engine hours, and use of the engine (such as time at certain engine settings) during operation. The remaining useful engine life may be predicted on the basis of engine performance parameters as measured by engine sensors, such as gas path temperatures and pressures, and shaft rotational speeds, or may be determined by a fixed number of operating cycles, engine hours etc. The measured parameters may be input to an analytical engine model, which outputs a remaining useful engine life $T_r$. At the expiry of the remaining engine life, the engine is generally subject to an overhaul (either on wing or off wing), during which components are inspected and/or replaced. In some cases, the remaining useful engine life $T_r$ may comprise a remaining life of a particular life limiting component, such as the high pressure turbine 24.

In a second step, a remaining life fuel burn $FB_{current}$ at a current target tip clearance $D_{current}$ is determined. The method comprises utilising an engine model which takes tip clearance D as an input, and outputs fuel burn, which may be in terms of specific fuel consumption for example. The specific fuel consumption is then used to determine total fuel burn prior to expiry of the remaining useful life. For example, where remaining useful life is in terms of cycles, the engine model may determine typical total impulse for each cycle (i.e. the average thrust multiplied by the cycle duration), then multiply this by the predicted remaining life $T_r$. The typical total impulse for each cycle may be determined by measuring the total impulse from previous flight cycles of that engine, and averaging these to provide a typical total impulse.

In a third step, a remaining life fuel burn change $\Delta FB_{reduced}$ at a reduced target tip clearance $D_{reduced}$ is determined. The remaining life fuel burn change $\Delta FB_{reduced}$ is a reduction or increase of remaining life fuel burn if there is no tip rub at the reduced clearance $D_{reduced}$. The reduced tip clearance $D_{reduced}$ may comprise a set reduced clearance compared to a current target tip gap $D_{target}$. For example, where the current target tip gap is 1.5 mm, the reduced target tip clearance may be 1.4 mm. Again, the engine model is utilised to make this determination.

In a fourth step, a probability of a tip rub $P_{rub}$ prior to expiry of the remaining useful engine life $T_r$ is determined. A "tip rub" will be understood to occur where the clearance 36 is reduced to zero momentarily. Tip rubs can be caused due to out of balance conditions of the engine (which may be caused by foreign object ingestion for example), sudden thermal transients (such as increased engine thrust over a short period of time), or sudden manoeuvres (particularly where the engine is installed on a military aircraft). The engine 10 is designed to accommodate tip rubs, by the provision of an abradable liner provided on the internal surface of the engine casing, or on the tips of the blades 26 themselves. However, where a tip rub occurs, the clearance 36 subsequent to the rub will generally be increased due to erosion of the abradable lining, leading to increased gas leakage past the blades 26, and so increased fuel consumption until the engine is overhauled.

In general, the probability of a tip rub $P_{rub}$ is related to the clearance 36, i.e. generally, the probability of a tip rub increases as the clearance is reduced. Similarly, the probability of a tip rub generally increases in relation to the remaining useful engine life. Consequently, in the second step, a probability model is employed to determine the overall probability of a tip rub $P_{rub}$ using remaining useful engine life and the reduced tip clearance 36 as inputs. The model may assume that the probability is inversely proportional to the clearance 36, and proportional to the remaining engine useful life, or may be more complex. For example, the model may be of the form:

$$P_{rub} = \frac{a}{\text{clearance}} \times \text{remaining life}$$

Where a is a predetermined constant.

In a fifth step, a change of overall remaining life fuel burn $\Delta FB_{rub}$ associated with a tip rub is determined, i.e. the increase in overall remaining life fuel burn relative to the current overall remaining life fuel burn that would be caused if a rub occurred. In general, as discussed above, a tip rub will result in an increased tip clearance for the remainder of the engine life. Consequently, the method comprises determining the increased clearance 36 in the event of a tip rub at the reduced clearance, and utilising the above engine model which takes tip clearance D as an input to determine total remaining life fuel burn change.

In a sixth step, a risk adjusted overall remaining life fuel burn reduction $\Delta FB_{adjusted}$ is calculated, which takes into account the reduction in overall fuel burn where the clearance is reduced, the increase in fuel burn where a rub occurs, and the probability of a rub at the reduced clearance, as follows:

$$\Delta FB_{adjusted} = (\Delta FB_{rub} \times P_{rub}) + (\Delta FB_{reduced} \times (1 - P_{rub}))$$

In a seventh step, where the risk adjusted overall remaining life fuel burn change $\Delta FB_{adjusted}$ is less than 0, i.e. the risk adjusted overall fuel burn is reduced compared to the remaining life fuel burn at the current tip clearance $FB_{current}$, then the tip clearance controller 40 operates the tip clearance control system 38 to provide a target tip clearance $D_{target}$ that is equal to the reduced tip clearance $D_{reduced}$. If the risk adjusted overall remaining life fuel burn change $\Delta FB_{adjusted}$ is greater than 0, the target tip clearance $D_{target}$ is maintained at the current clearance $D_{current}$.

The method is then continually iterated. The method may further comprise providing an increased target tip clearance $D_{increased}$, and substituting this for the reduced target tip clearance $D_{reduced}$ in the above method, to determine whether an increased target tip clearance will result in a reduced overall lifetime fuel burn in view of the reduced probability of a tip rub.

As will be understood, the net effect of the above method will be a reduction in tip clearance as a function of remaining engine useful life, as $P_{rub}$ will decrease as remaining useful engine life decreases.

As a check, to ensure that the reduced tip clearance does not reduce the abradable lining to less than a minimum required thickness, and so damage the engine, the method optionally comprises performing an abradable liner thickness check prior to the seventh step. In the abradable liner thickness check, a model is employed to determine a predicted abradable liner thickness at the end of the useful service life where the target tip gap $D_{target}$ is set to the reduced target $D_{reduced}$. The model may use the probability of a tip rub and the remaining useful engine life $T_r$ as input, along with an estimate of current abradable liner thickness and projected reduced liner thickness in the event of each tip rub. If the predicted abradable liner thickness with the reduced target tip gap $D_{reduced}$ exceeds a predetermined threshold, then the target tip gap $D_{target}$ is set as the reduced tip gap $D_{reduced}$. Otherwise, the target tip gap $D_{target}$ is maintained at the current tip gap $D_{current}$.

While the invention has been described in conjunction with the exemplary embodiments described above, many equivalent modifications and variations will be apparent to those skilled in the art when given this disclosure. Accordingly, the exemplary embodiments of the invention set forth above are considered to be illustrative and not limiting. Various changes to the described embodiments may be made without departing from the spirit and scope of the invention.

For example, alternative means of tip clearance control could be provided. For example, the active tip clearance control system could comprise a pneumatic system, comprising a flexible shroud actuated by pressurised air to control the gap. The control system could comprise one or more tip clearance sensors in place of a schedule to determine current tip clearance.

The control system could be configured to control a tip clearance of a high or intermediate pressure turbine, or of a compressor. The system could be used in land, air or marine gas turbines.

Aspects of any of the embodiments of the invention could be combined with aspects of other embodiments, where appropriate.

The invention claimed is:

1. A method of controlling a rotor tip clearance in a gas turbine engine, the method comprising:

determining an engine or component remaining useful life $T_r$;

predicting a current rotor tip clearance; and controlling a tip clearance control arrangement to maintain the predicted current rotor tip clearance at a target tip clearance $D_{target}$, wherein the target tip clearance $D_{target}$ is determined in accordance with a function of remaining engine life $T_r$, and the target tip clearance $D_{target}$ is periodically updated over a life of the engine in accordance with the function of remaining engine life $T_r$.

2. A method according to claim 1, wherein the step of determining the target tip clearance $D_{target}$ further comprises:

a. determining a nominal remaining life fuel burn change $\Delta FB_{reduced}$ associated with a reduced tip clearance $D_{reduced}$;

b. determining a tip rub probability $P_{rub}$ associated with the reduced tip clearance $D_{reduced}$;

c. determining a remaining life fuel burn change $\Delta FB_{rub}$ associated with a tip rub;

d. determining a risk adjusted remaining life fuel burn $FB_{adjusted}$ for the reduced tip clearance; and e. where the risk adjusted remaining engine life fuel burn change $\Delta FB_{adjusted}$ is less than zero, setting the target tip clearance $D_{target}$ to the reduced tip clearance $D_{reduced}$.

3. A method according to claim 2, wherein the step of determining the target tip clearance $D_{target}$ further comprises:

predicting an abradable liner thickness at the expiry of the remaining useful life $T_r$ where the engine is operated at the reduced tip clearance $D_{reduced}$, and setting the target tip clearance $D_{target}$ at the reduced tip clearance $D_{target}$ only where the predicted abradable liner thickness at the expiry of the remaining useful life exceeds a minimum threshold.

4. A method according to claim 1, wherein the rotor comprises one of a turbine rotor and a compressor.

5. A method according to claim 1, wherein the remaining engine life comprises one or more of a number of flight hours prior to the next engine overhaul, and a number of flight cycles prior to the next engine overhaul.

6. A gas turbine engine rotor tip clearance control apparatus comprising a tip clearance controller configured to (1) predict a current rotor tip clearance and (2) maintain the predicted current tip clearance at a target tip clearance $D_{target}$, the target tip clearance being determined in accordance with a function of remaining engine life $T_r$, and the target tip clearance $D_{target}$ being updated over a life of the engine in accordance with the function of remaining engine life $T_r$.

* * * * *